US005375936A

United States Patent [19]

Jennison et al.

[11] Patent Number: 5,375,936

[45] Date of Patent: Dec. 27, 1994

[54] MODULAR SHEET DISPLAY ALBUM

[76] Inventors: Rock E. Jennison; Karen J. Jennison, both of 5808A E. Bradshaw, Fort Polk, La. 71459

[21] Appl. No.: 26,405

[22] Filed: Mar. 4, 1993

[51] Int. Cl.[5] ..... B42F 13/00

[52] U.S. Cl. ..... 402/73; 281/28; 281/31; 281/36

[58] Field of Search ..... 281/21.1, 36, 28, 31; 402/73; 40/159, 405, 537, 605; 206/455, 472

[56] References Cited

U.S. PATENT DOCUMENTS

| | | | |
|---|---|---|---|
| 2,318,192 | 5/1943 | Boelema, Jr. | 281/31 |
| 2,850,294 | 9/1958 | Ortis et al. | 281/31 |
| 3,797,152 | 3/1974 | Brandt | 40/159 X |
| 3,921,322 | 11/1975 | Sharp | 40/159 X |
| 4,172,332 | 10/1979 | Holes et al. | 281/31 X |
| 4,676,374 | 6/1987 | Wilkins | 206/455 X |
| 5,119,574 | 6/1992 | King | 40/537 |

FOREIGN PATENT DOCUMENTS

| | | | |
|---|---|---|---|
| 399997 | 11/1990 | European Pat. Off. | 40/605 |
| 470908 | 2/1992 | European Pat. Off. | 40/124.1 |
| 478848 | 3/1953 | Italy | 40/405 X |

*Primary Examiner*—Mark Rosenbaum
*Assistant Examiner*—Frances Han

[57] ABSTRACT

A new and improved modular sheet display album apparatus includes a plurality of sheet display modules and an album binder assembly. An individual sheet display module includes a frame assembly for framing and retaining a sheet within the module, and complementary first connectors (tongues) and second connectors (grooves), attached to opposite sides of the module, for connecting adjacent modules to each other to form a page in the album. The album binder assembly supports the plurality of sheet display modules in album form. The album binder assembly includes a spine element and a support assembly, connected to the spine element, for supporting a plurality of module support bars. The module support bars include apertures for connecting the module support bars to the support assembly and which also include third connectors on the support bars which are complementary to the first connectors, for connecting the support bars to the first connectors on the display modules. The support assembly on the spine element for supporting the support bars may include a plurality of openable and closable rings. The album binder assembly also includes first hinge elements connected to the spine element, at least one cover element which includes second hinge elements, and at least one pin for connecting the spine element to the at least one cover element by connecting the first hinge elements and the second hinge elements together.

13 Claims, 5 Drawing Sheets

FIG 5
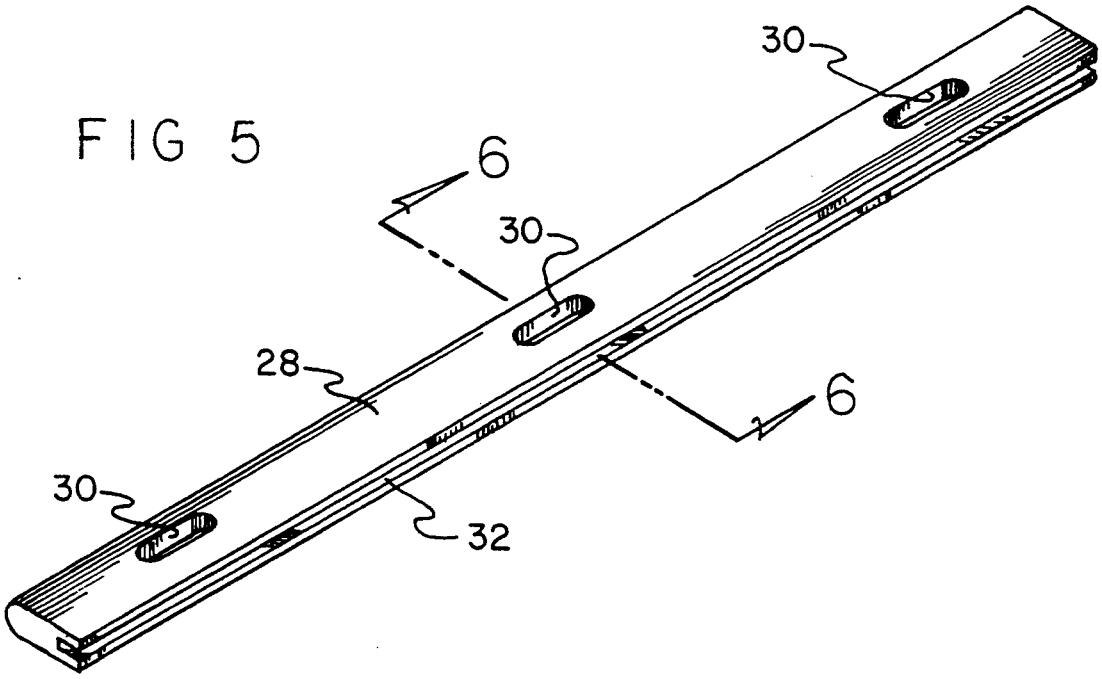
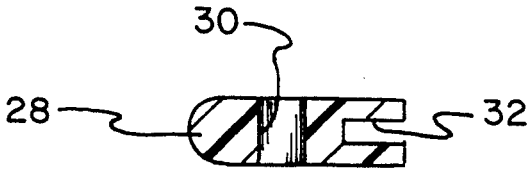
FIG 6
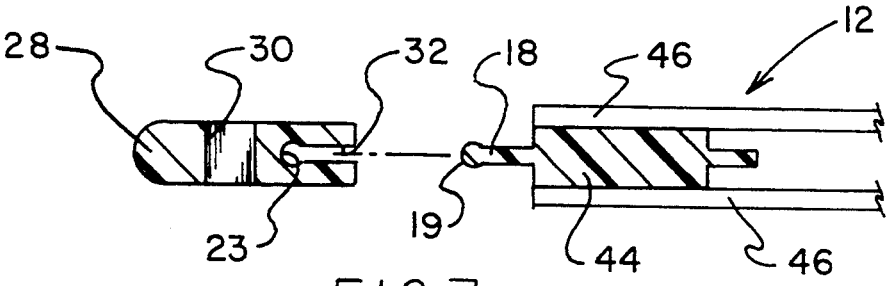
FIG 7

MODULAR SHEET DISPLAY ALBUM

BACKGROUND OF THE INVENTION

1. Field of the Invention

The present invention relates generally to receptacles and albums for cards, photographs, and other sheet-like collectible items, and more particularly, to protective containers which provide storage for the items and enable handling of the items without touching the items themselves.

2. Description of the Prior Art

Receptacles and albums for cards, photographs, and other sheet-like collectible items are well known in the art. Protection of the collectible item from fingerprints and other forms of soiling from handling is desired. For example, U.S. Pat. No. 4,809,451 of Suzuki discloses a protective print holder which permits handling of the print without touching the print. Similarly, U.S. Pat. No. 4,889,748 of Dudley discloses a sealed, protective device for a postage stamp. However, the prior art does not provide means for organizing and arranging a group of protected prints or postage stamps together in album form. In this respect, it would be desirable if an apparatus were provided in which individually protected sheets can be organized and arranged in album form.

In addition, the following U.S. patents disclose devices for mounting slides, but they do not provide means for arranging the slides in album form: U.S. Pat. No. 4,825,574 of George; and U.S. Pat. No. 4,836,377 of Heron. In addition, U.S. Pat. No. 4,873,135 of Wittnebel et al discloses a frame-like retainer for a visual transparency, but no provision is made to organize and arrange a plurality of transparencies into an album.

If a plurality of protected sheets were arranged as pages and organized in album form, it would be desirable to be capable of readily adding or deleting individually protected sheets from a page in the album. For an efficient usage of an album page, it would be desirable if a protected item could be viewed from either side of a page. In this respect, it would be desirable if a protective receptacle had two transparent sides so that two sheet-like items can be stored in a single receptacle back-to-back; and one item can be viewed through one transparent side, and the second item can be viewed through the other transparent side.

Some albums have permanent binders and a fixed, invariable number of pages. Other albums have binders which permit addition and deletion of a number of pages. In this respect, it would be desirable if an album were provided which included a binder which permitted addition or deletion of a number of pages, each of which contained a plurality of individually protected sheets.

Thus, while the foregoing body of prior art indicates it to be well known to use protective receptacles for collectibles in sheet form, the prior art described above does not teach or suggest an apparatus in which individual protected sheets can be organized and arranged in album form. Also, the prior art does not provide an album to which or from which one can readily add or delete individually protected sheets from the album. The prior art does not provide a sheet protector receptacle that has two transparent sides so that two sheet-like items can be stored in a single receptacle back-to-back; and one item can be viewed through one transparent side, and the second item can be viewed through the other transparent side. In addition, the prior art does not provide an album that includes a binder which permits addition or deletion of a number of pages, each of which contains a plurality of individually protected sheets. The foregoing disadvantages are overcome by the unique modular sheet display album apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved modular sheet display album apparatus which includes a plurality of sheet display modules and an album binder assembly. An individual sheet display module includes a frame assembly for framing and retaining a sheet within the module, and complementary first connectors (tongues) and second connectors (grooves), attached to opposite sides of the module, for connecting adjacent modules to each other to form a page. The album binder assembly supports in album form a plurality of pages, each of which includes a plurality of sheet display modules. The album binder assembly includes a spine element and a support assembly, connected to the spine element, for supporting a plurality of module support bars. The module support bars include apertures for connecting the module support bars to the support assembly and which also include third connectors on the support bars which are complementary to the first connectors, for connecting the support bars to the first connectors on the display modules. The support assembly on the spine element for supporting the support bars may include a plurality of openable and closable rings.

The album binder assembly includes first hinge elements connected to the spine element, at least one cover element which includes second hinge elements, and at least one pin for connecting the spine element to the at least one cover element by connecting the first hinge elements and the second hinge elements together.

In accordance with another aspect of the invention, a new and improved sheet display module is provided which serves as a receptacle for receiving a sheet to be protected and displayed. The improved sheet display module includes a first pair and a second pair of oppositely positioned frame elements and two transparent planar sheet members connected to opposite sides of the frame elements. The transparent planar sheet members and the frame elements define a transparent receptacle for the sheet. First connectors (tongues) are located on the first pair of the frame elements, and second connectors (grooves) are located on the second pair of frame elements, the second connectors being complementary to the first connectors, wherein the first connectors on one module are used to connect that module to second connectors on an adjacent module, whereby adjacent modules are connected to each other, so they can form an album page.

More specifically, the frame elements are comprised of a three sided, C-shaped first frame element and a straight second frame element. Two opposing sides of the C-shaped first frame element constitute the first pair of oppositely positioned frame elements. The third side of the C-shaped first frame element and the straight second frame element constitute the second pair of oppositely positioned frame elements. The straight second frame element can serve as a removable and replaceable cap for the receptacle.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved modular sheet display album apparatus which has all of the advantages of the prior art and none of the disadvantages.

It is another object of the present invention to provide a new and improved modular sheet display album apparatus which may be easily and efficiently manufactured and marketed.

It is a further object of the present invention to provide a new and improved modular sheet display album apparatus which is of durable and reliable construction.

An even further object of the present invention is to provide a new and improved modular sheet display album apparatus which is susceptible of a low cost of manufacture with regard to both materials and labor, and which accordingly is then susceptible of low prices of sale to the consuming public, thereby making such modular sheet display album apparatus available to the buying public.

Still yet a further object of the present invention is to provide a new and improved modular sheet display album apparatus in which individually protected sheets can be organized and arranged in album form.

Still another object of the present invention is to provide a new and improved modular sheet display album apparatus which permits easy adding or deleting individually protected sheets from the album.

Yet another object of the present invention is to provide a new and improved modular sheet display album apparatus in which display modules have two transparent sides so that two sheet-like items can be stored in a single module back-to-back; and one item can be viewed through one transparent side, and the second item can be viewed through the other transparent side.

Even another object of the present invention is to provide a new and improved modular sheet display album apparatus which includes a binder which permits easy addition or deletion of a number of pages, each of which contains a plurality of individually protected sheets.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is an enlarged perspective view of a module support bar in the embodiment shown in FIG. 1.

FIG. 6 is a cross-sectional view of the module support bar shown in FIG. 5 taken along the line 6—6 thereof and showing a groove for receiving complementary tongues in sheet display modules.

FIG. 7 is a cross-sectional view of an alternate tongue and groove arrangement wherein the tongue has a bulbous edge, and the groove has a complementary recess for receiving the bulbous edge.

DESCRIPTION OF THE PREFERRED EMBODIMENT

Figure 1:
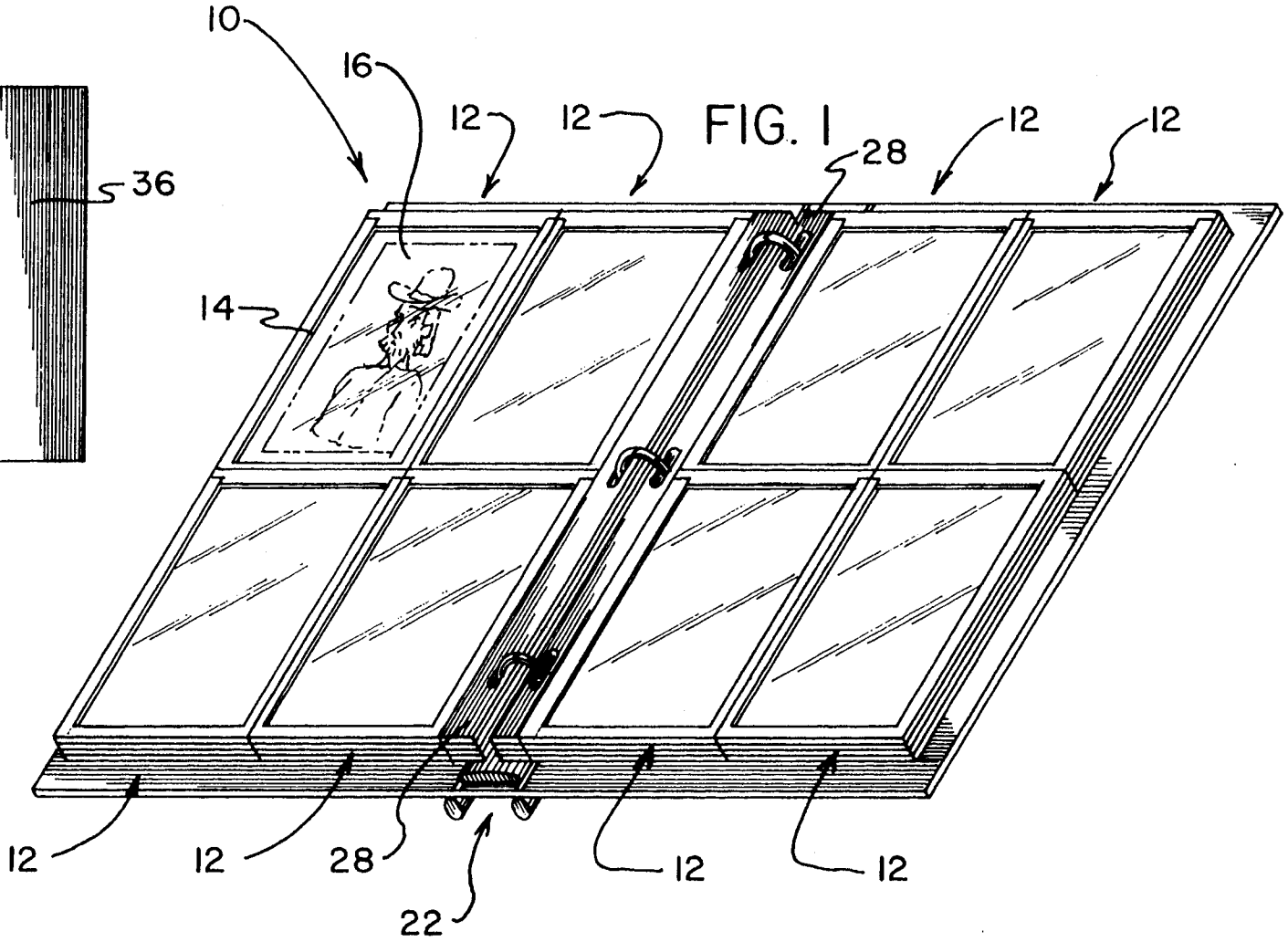
FIG. 1 is a perspective view showing a first preferred embodiment of the modular sheet display album apparatus of the invention with the album in an open orientation.
Figure 2:
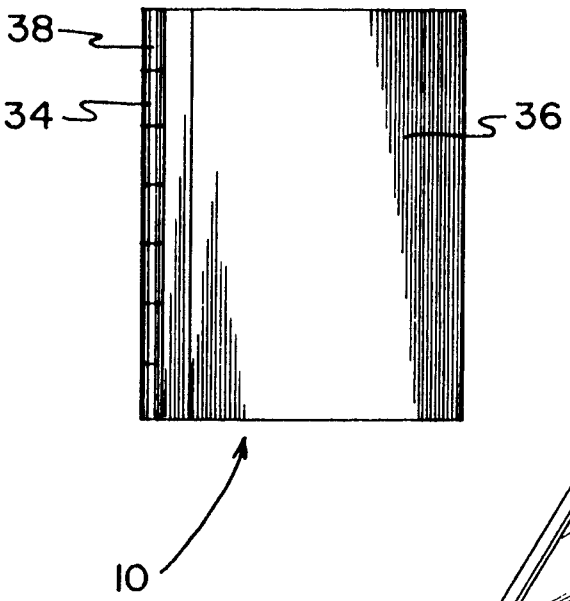
FIG. 2 is a plan view of the embodiment shown in FIG. 1 in a closed orientation.

With reference to the drawings, a new and improved modular sheet display album apparatus embodying the principles and concepts of the present invention will be described.

Turning initially to FIGS. 1–8, there is shown a first exemplary embodiment of the modular sheet display album apparatus of the invention generally designated by reference numeral 10. In its preferred form, modular sheet display album apparatus 10 includes a plurality of sheet display modules 12 which include a frame assembly 14 for framing and retaining a sheet 16 within a module 12.

Figure 8:
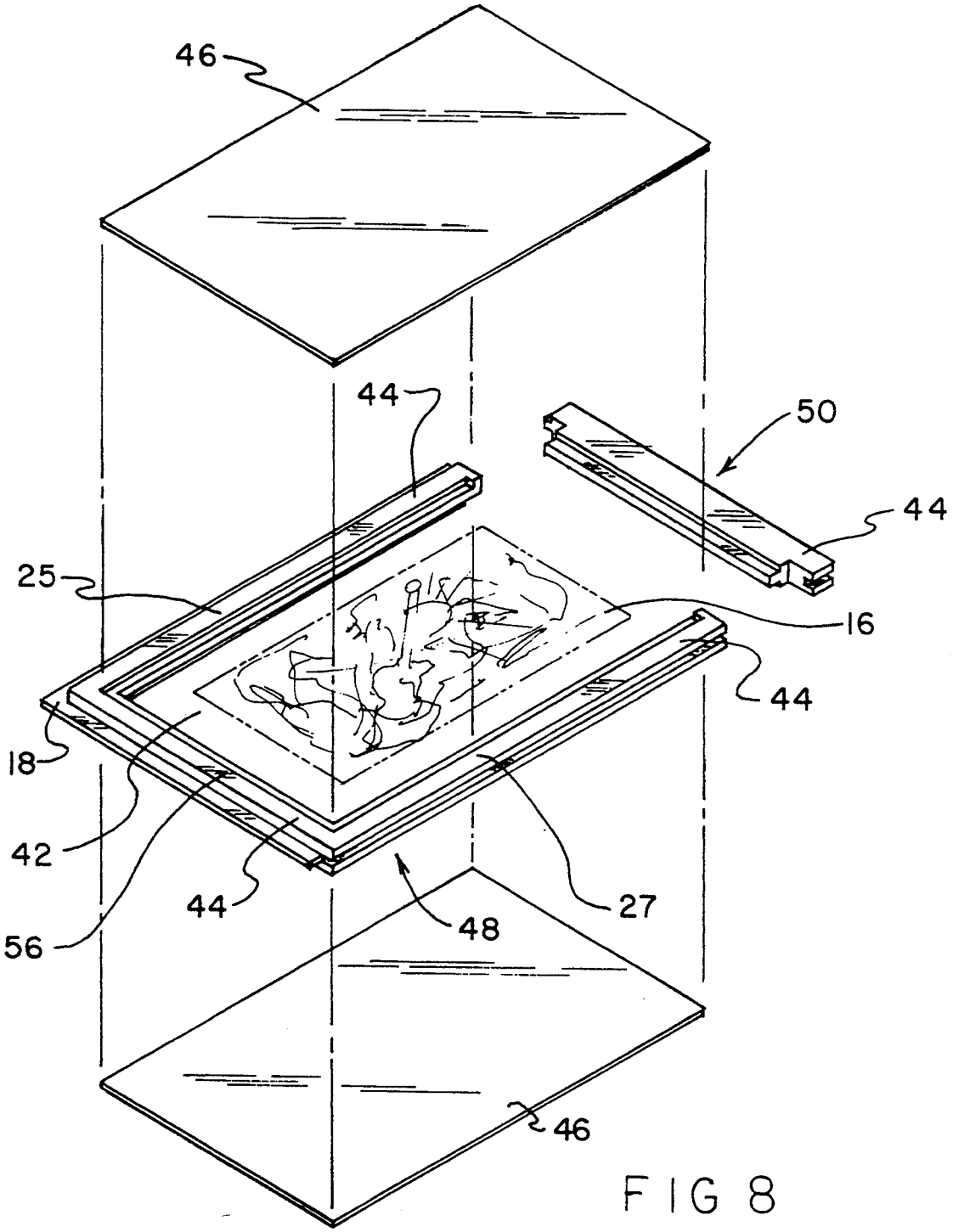
FIG. 8 is an exploded perspective view of an embodiment of a sheet display module of the invention such as shown in FIG. 1 and which includes a three sided, C-shaped first frame element and a straight second frame element.

As shown in detail in FIG. 8, complementary first connecting means 18 (tongue 18) and second connecting means 20 (groove 20) are attached to opposite sides 25 and 27, respectively, of a module 12, for connecting adjacent modules 12 to each other.

As shown in detail in FIGS. 1 and 3–7, an album binder assembly 22 is used for supporting the plurality of sheet display modules 12 in album form. The album binder assembly 22 includes a spine element 24 and openable and closable rings 26, connected to the spine element 24, for supporting a plurality of module support bars 28. The plurality of module support bars 28 include apertures 30 for connecting the module support bars 28 to the support rings 26. The support bars 28 also include support bar connecting grooves 32, complementary to the first connecting tongues 18, for connecting the support bars 28 to the first connecting tongues 18 on the modules 12. A page in the album is constituted by the combination of a support bar 28 and the modules 12 supported by the support bar 28.

Figure 3:
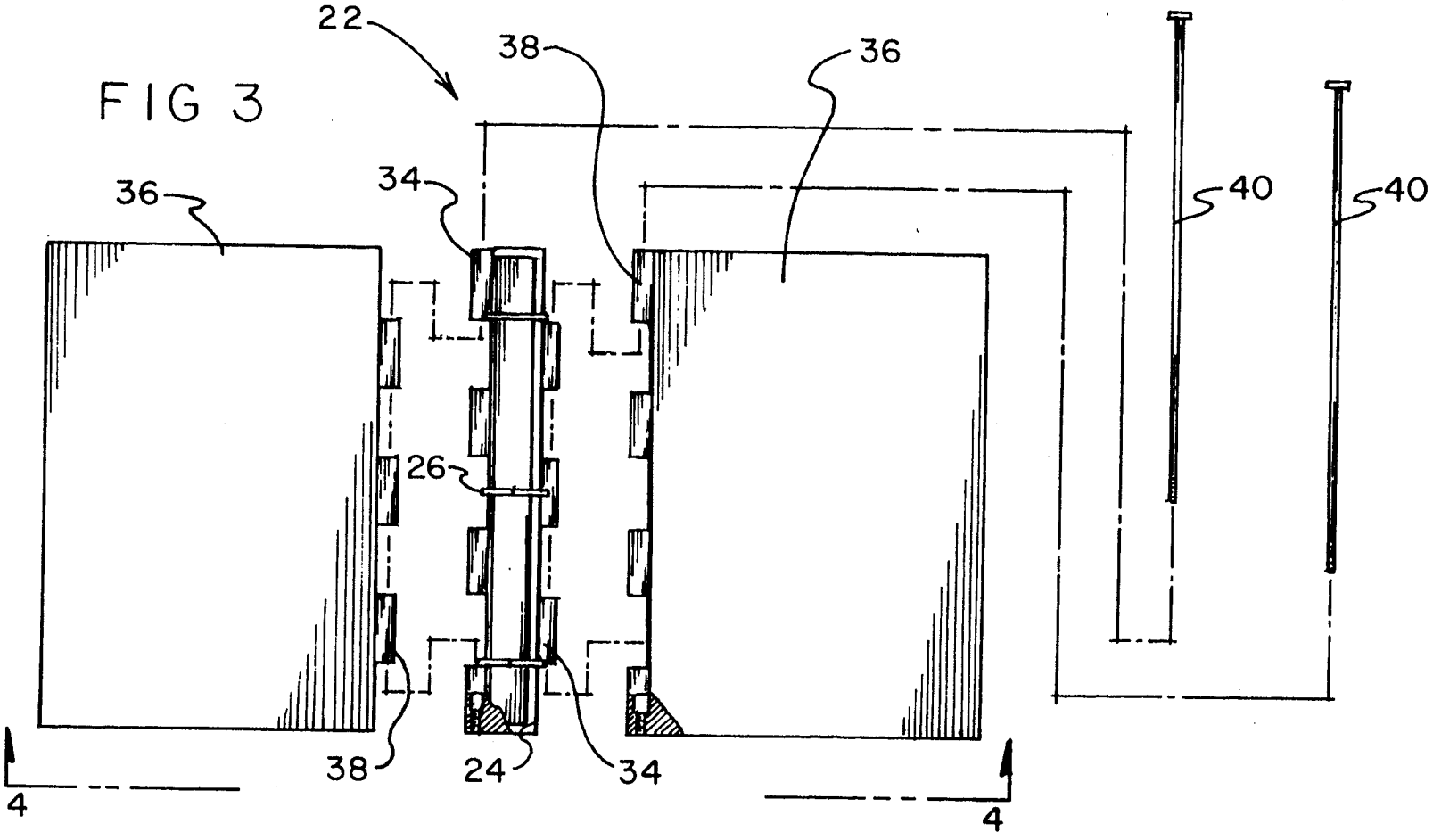
FIG. 3 is an exploded plan view of the album binder assembly of the embodiment shown in FIG. 1.
Figure 4:
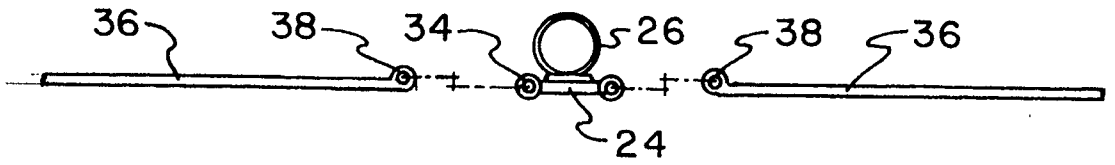
FIG. 4 is a side view of a portion of the album binder assembly shown in FIG. 3 taken along the line 4—4 thereof.

As shown in detail in FIG. 3, the album binder assembly 22 further includes first hinge elements 34 connected to the spine element 24, two cover elements 36 which include second hinge elements 38, and pins 40 for connecting the spine element 24 to the two cover elements 36 by connecting the first hinge elements 34 and the second hinge elements 38 together. The pins 40 are placed in position when the holes in the hinge elements are placed in registration with each other.

As shown in FIG. 7, the tongue element 18 of a module 12 can include a bulbous edge portion 19. Similarly, a support bar connecting groove 32 can include a rounded recess 23 for receiving the bulbous edge portion 19 of the module tongue element 18. It is also noted, though not shown, that a module groove element 20 also includes a rounded recess for receiving a bulbous edge portion 19 of a module tongue element 18.

With further reference to the exploded view shown in FIG. 8, when the elements in the exploded view are moved together along the view lines indicated, a receptacle 42 is formed for receiving a sheet 16. More specifically, the receptacle 42 includes a first pair and a second pair of oppositely positioned frame elements 44 and two transparent planar sheet members 46 connected to opposite sides of the frame elements 44, wherein the planar sheet members 46 and the frame elements 44 define a transparent receptacle for the sheet 16. The transparent planar sheet members 46 may be connected to the frame elements 44 by an adhesive material or other suitable means. The first connecting tongue 18 on one module 12 is used to connect that module to a second connecting groove 20 on an adjacent module, whereby adjacent modules are connected to each other.

Even more specifically, the frame elements 44 are comprised of a three sided, C-shaped first frame element 48 and a straight second frame element 50. Two opposing sides 25 and 27 of the C-shaped first frame element 48 constitute a first pair of oppositely positioned frame elements 44, and the third side 56 of the C-shaped first frame element 48 and the straight second frame element 50 constitute a second pair of oppositely positioned frame elements.

Adhesive material need not be applied between the two transparent planar sheet members 46 and the straight second frame element 50. In this manner, the straight second frame element 50 serves as a removable and replaceable cap for the receptacle 42 and is secured between overlapping portion of the two transparent planar sheet members 46 by a friction fit.

Figure 9:
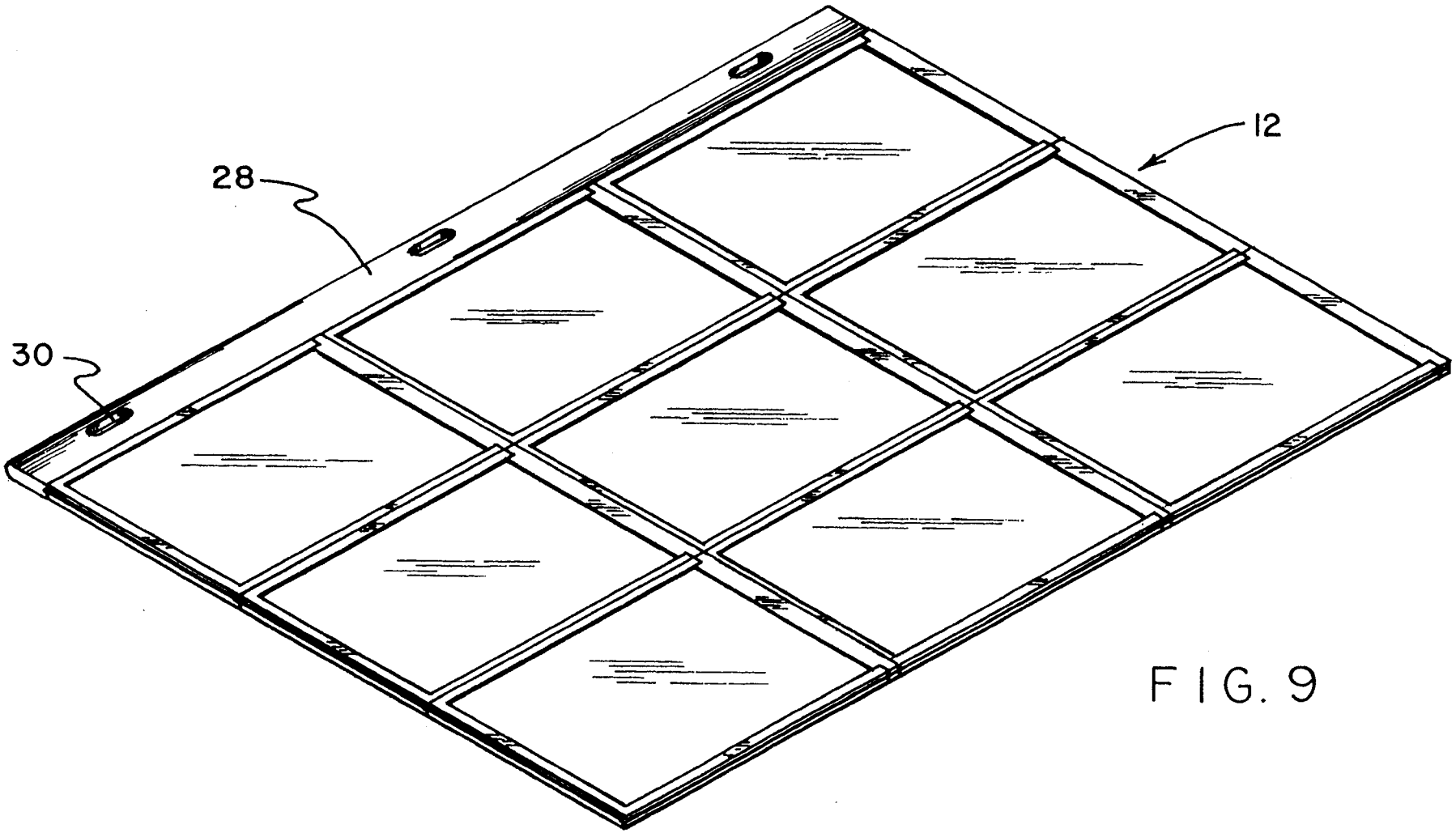
FIG. 9 is a perspective view of a single page of a second embodiment of the modular sheet display album apparatus of the invention wherein the page includes nine sheet display modules in a three by three arrangement.

Turning to FIG. 9, a second embodiment of the modular sheet display album apparatus of the invention is shown. Reference numerals are shown that correspond to like reference numerals that designate like elements shown in the other figures. More specifically, a single page of a second embodiment of the modular sheet display album apparatus of the invention is shown wherein the page includes nine sheet display modules in a three by three arrangement.

Most of the components that comprise the modular sheet display album apparatus of the invention can be made from inexpensive plastic materials. Preferably, however, the support rings and the mechanism provided for permitting opening and closing of the support rings are made of metal and are very similar to readily available ring operating mechanisms such as are currently used in some conventional albums and in three-ring notebooks. The hinges and the pins may also preferably be made from metal. The modules can be in a variety of sizes ranging from small to medium to large. An important factor in selecting module dimensions is that a plurality of modules, when connected together, form a page in the album.

It is apparent from the above that the present invention accomplishes all of the objects set forth by providing a new and improved modular sheet display album apparatus that is low in cost, relatively simple in design and operation, and which may advantageously be used in which individually protected and housed sheets can be organized and arranged in album form.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the U.S. is as follows:

1. A new and improved modular sheet display album apparatus, comprising:

a plurality of sheet display modules which include, frame assembly means for framing and retaining a sheet within a module, and complementary selectively engageable and disengageable first connecting means and second connecting means, attached to opposite sides of a module, for selectively connecting adjacent modules to each other and for selectively disconnecting adjacent modules from each other, and an album binder assembly means for supporting said plurality of sheet display modules in album form, wherein said album binder assembly means include a spine element, means for supporting a plurality of module support bars connected to said spine element, and a plurality of module support bars which include apertures for connecting said module support bars to said support means and which also include support bar connecting means, complementary to said first connecting means, for connecting said support bars to said first connecting means on said modules.

2. The apparatus described in claim 1 wherein said means for supporting a plurality of module support bars include a plurality of openable and closable rings.

3. The apparatus described in claim 1 wherein said album binder assembly means further includes:

first hinge elements connected to said spine element, at least one cover element which includes second hinge elements, and pin means for connecting said spine element to said at least one cover element by connecting said first hinge elements and said second hinge elements together.

4. A new and improved modular sheet display album apparatus, comprising:

a plurality of sheet display modules which include, frame assembly means for framing and retaining a sheet within a module, and complementary first connecting means and second connecting means, attached to opposite sides of a module, for connecting adjacent modules to each other, and an album binder assembly means for supporting said plurality of sheet display modules in album form, wherein said album binder assembly means include a spine element, means, connected to said spine element, for supporting a plurality of module support bars, and a plurality of module support bars which include apertures for connecting said module support bars to said support means and which also include support bar connecting means, complementary to said first connecting means, for connecting said support bars to said first connecting means on said modules, wherein said first connecting means of a module include module tongue elements.

5. The apparatus described in claim 4 wherein a module tongue element includes a bulbous edge portion.

6. The apparatus described in claim 4 wherein said support bar connecting means of album binder assembly means include support bar groove elements.

7. The apparatus described in claim 4 wherein a support bar groove element includes a rounded recess for receiving a bulbous edge portion of a module tongue element.

8. The apparatus described in claim 4 wherein said second connecting means of a module include module groove elements.

9. The apparatus described in claim 8 wherein a module groove element includes a rounded recess for receiving a bulbous edge portion of a module tongue element.

10. A new and improved sheet display module, comprising:

receptacle means for receiving a sheet, wherein said receptacle means includes a first pair and a second pair of oppositely positioned frame elements and two transparent planar sheet members connected to opposite sides of said frame elements, wherein said transparent planar sheet members and said frame elements define a transparent receptacle for said sheet, first connecting means located on one of each of said first and second pairs of oppositely positioned frame elements, and second connecting means located on one of each of said first and second pairs of oppositely positioned frame elements, said second connecting means being complementary to said first connecting means, wherein said first connecting means on one module are used to connect that module to second connecting means on an adjacent module, whereby adjacent modules are connected to each other, wherein said frame elements are comprised of a three sided, C-shaped first frame element and a straight second frame element, wherein two opposing sides and of said C-shaped first frame element constitute said first pair of oppositely positioned frame elements, and wherein the third side of said C-shaped first frame element and said straight second frame element constitute said second pair of oppositely positioned frame elements.

11. The apparatus described in claim 10 wherein said straight second frame element serves as a removable and replaceable cap for said receptacle means.

12. The apparatus described in claim 10 wherein said first connecting means of a module include module tongue elements.

13. The apparatus described in claim 10 wherein said second connecting means of a module include module groove elements.

* * * * *